US006209871B1

(12) United States Patent
Butler

(10) Patent No.: US 6,209,871 B1
(45) Date of Patent: Apr. 3, 2001

(54) METHOD OF PLAYING A BOARD GAME

(76) Inventor: Colin Butler, 21 Summerfield Green, Clonsilla Road, Dublin 15 (IE)

( * ) Notice: Subject to any disclaimer, the term of this patent is extended or adjusted under 35 U.S.C. 154(b) by 0 days.

(21) Appl. No.: 09/410,321

(22) Filed: Oct. 1, 1999

(51) Int. Cl.[7] ..... A63F 3/00
(52) U.S. Cl. ..... 273/243; 273/236; 273/249
(58) Field of Search ..... 273/236, 242, 273/243, 430, 431, 249

(56) References Cited

U.S. PATENT DOCUMENTS 4,013,294 * 3/1977 Smeda .
4,273,337 * 6/1981 Carrera .
4,583,741 * 4/1986 Brisciano .
4,984,805 * 1/1991 Medlock .
5,013,048 * 5/1991 Turner .
5,071,134 * 12/1991 Burroughs .
5,121,928 * 6/1992 Salerno-Sonnenberg .
5,758,877 * 6/1998 Liddell .

* cited by examiner

*Primary Examiner*—Benjamin H. Layno
*Assistant Examiner*—Vishu Mendiratta

(57) ABSTRACT

A board game apparatus for learning about occupational trivia in a game setting. The board game apparatus includes a game board. The game board is subdivided into compartments, the compartments each being in the form of a path to be followed by participants in the game. The compartments have associated therewith a reference to a respective occupation. The occupation is chosen from the group consisting of professions, industry, tourism and public service. A plurality of cards having indicia thereon wherein the indicia indicates questions corresponding to an occupation. At least one die and a counter for keeping score. A participant landing on a compartment is required to answer a question on a card that corresponds to the compartment. The participant acquires points as a result of correct answers.

2 Claims, 5 Drawing Sheets

METHOD OF PLAYING A BOARD GAME

BACKGROUND OF THE INVENTION

1. Field of the Invention

The present invention relates to board games and more particularly pertains to a new board game apparatus for learning about occupational trivia in a game setting.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,503,399; U.S. Pat. No. 4,936,589; U.S. Pat. No. 5,356,153; U.S. Pat. No. 4,962,934; U.S. Pat. No. 2,693,961; and U.S. Pat. Des. No. 356,343.

While these devices fulfill their respective, particular objectives and requirements, the aforementioned patents do not disclose a new board game apparatus. The inventive device includes a game board with an upper side, a bottom side, a left side and a right side. The game board is subdivided into compartments, the compartments each being in the form of a path to be followed by participants in the game. The compartments have associated therewith a reference to a respective occupation. The occupation is chosen from the group consisting of professions, industry, tourism and public service. A plurality of cards having indicia thereon wherein the indicia indicates questions corresponding to an occupation. At least one die and a counter for keeping score. A participant landing on a compartment is required to answer a question on a card that corresponds to the compartment. The participant acquires points as a result of correct answers.

In these respects, the board game apparatus according to the present invention substantially departs from the conventional concepts and designs of the prior art, and in so doing provides an apparatus primarily developed for the purpose of learning about occupational trivia in a game setting.

SUMMARY OF THE INVENTION

In view of the foregoing disadvantages inherent in the known types of board games now present in the prior art, the present invention provides a new board game apparatus construction wherein the same can be utilized for learning about occupational trivia in a game setting.

The general purpose of the present invention, which will be described subsequently in greater detail, is to provide a new board game apparatus apparatus and method which has many of the advantages of the board games mentioned heretofore and many novel features that result in a new board game apparatus which is not anticipated, rendered obvious, suggested, or even implied by any of the prior art board games, either alone or in any combination thereof.

To attain this, the present invention generally comprises a game board with an upper side, a bottom side, a left side and a right side. The game board is subdivided into compartments, the compartments each being in the form of a path to be followed by participants in the game. The compartments have associated therewith a reference to a respective occupation. The occupation is chosen from the group consisting of professions, industry, tourism and public service. A plurality of cards having indicia thereon wherein the indicia indicates questions corresponding to an occupation. At least one die and a counter for keeping score. A participant landing on a compartment is required to answer a question on a card that corresponds to the compartment. The participant acquires points as a result of correct answers.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new board game apparatus apparatus and method which has many of the advantages of the board games mentioned heretofore and many novel features that result in a new board game apparatus which is not anticipated, rendered obvious, suggested, or even implied by any of the prior art board games, either alone or in any combination thereof.

It is another object of the present invention to provide a new board game apparatus which may be easily and efficiently manufactured and marketed.

It is a further object of the present invention to provide a new board game apparatus which is of a durable and reliable construction.

An even further object of the present invention is to provide a new board game apparatus which is susceptible of a low cost of manufacture with regard to both materials and labor, and which accordingly is then susceptible of low prices of sale to the consuming public, thereby making such board game apparatus economically available to the buying public.

Still yet another object of the present invention is to provide a new board game apparatus which provides in the apparatuses and methods of the prior art some of the advantages thereof, while simultaneously overcoming some of the disadvantages normally associated therewith.

Still another object of the present invention is to provide a new board game apparatus for learning about occupational trivia in a game setting.

Yet another object of the present invention is to provide a new board game apparatus which includes teaching new careers.

Still yet another object of the present invention is to provide a new board game apparatus that teaches general trivia.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
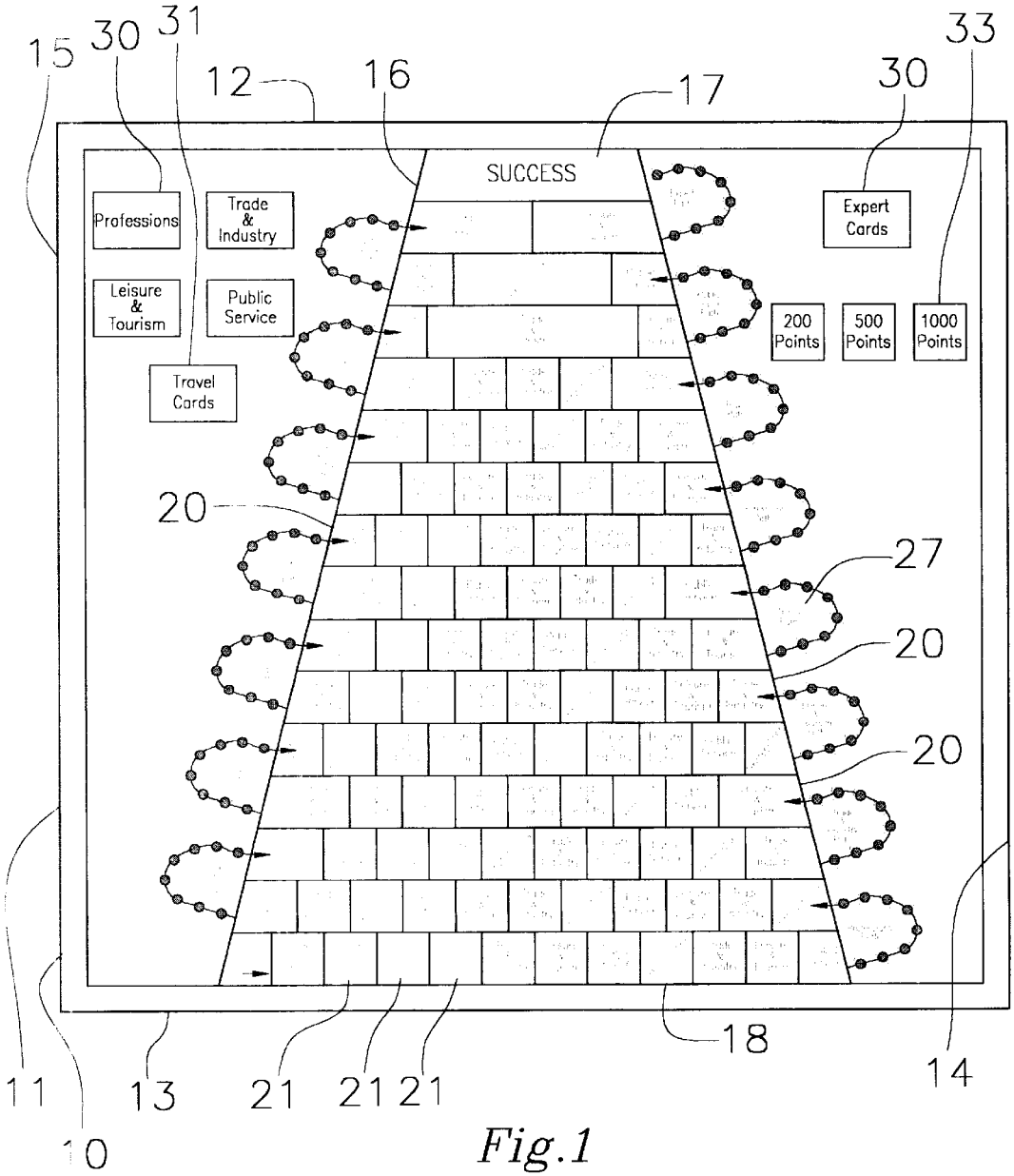
FIG. 1 is a schematic front view of a new board game apparatus according to the present invention.
Figure 2:
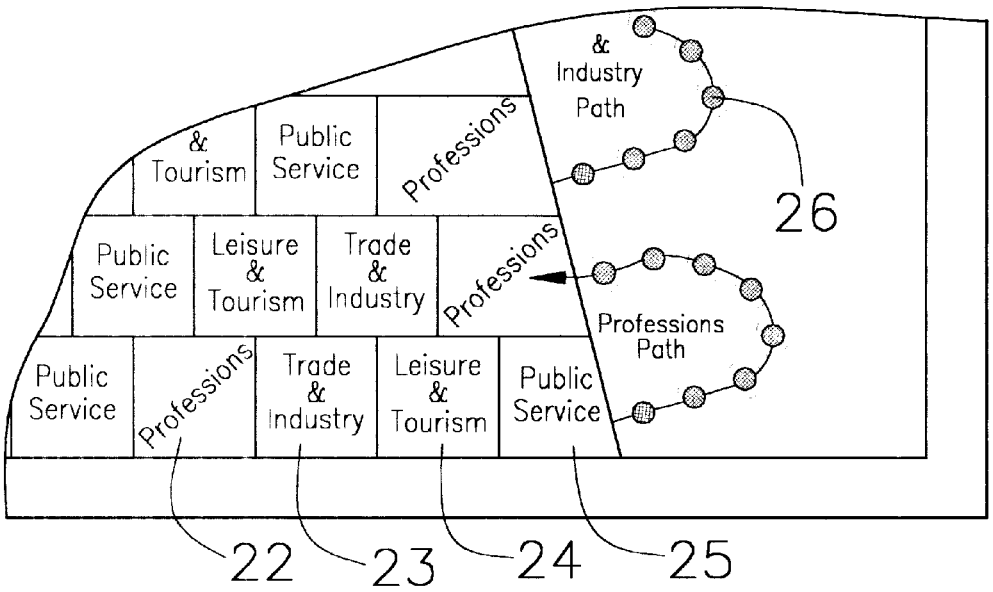
FIG. 2 is a schematic exploded view of the compartments of the present invention.
Figure 3:
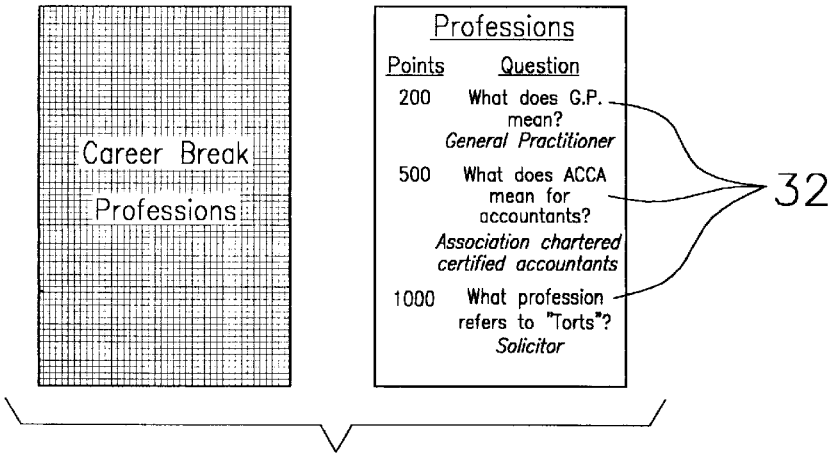
FIG. 3 is a schematic front and back view of an example trivia card of the present invention.
Figure 4:
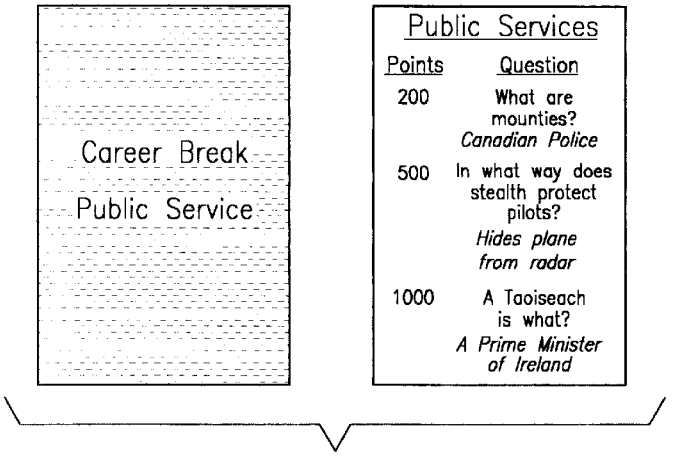
FIG. 4 is a schematic front and back view of an example trivia card of the present invention.
Figure 5:
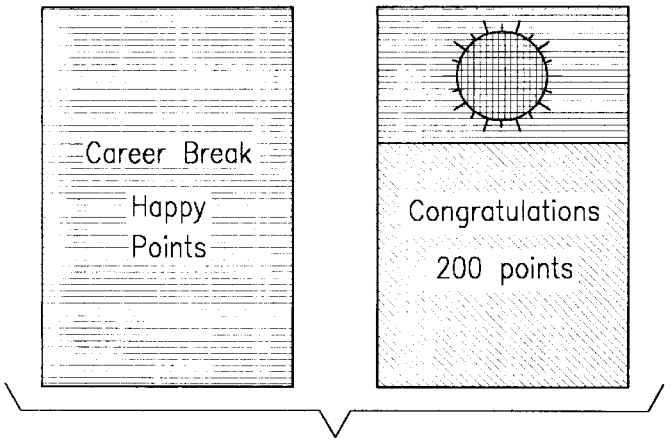
FIG. 5 is a schematic front and back view of an example point card of the present invention.
Figure 6:
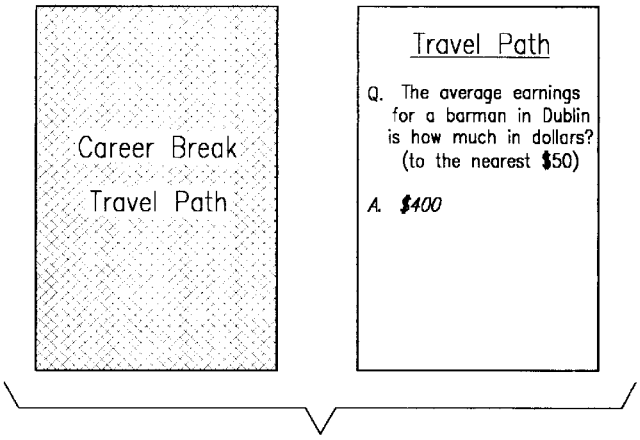
FIG. 6 is a schematic front and back view of an example trivia card of the present invention.
Figure 7:
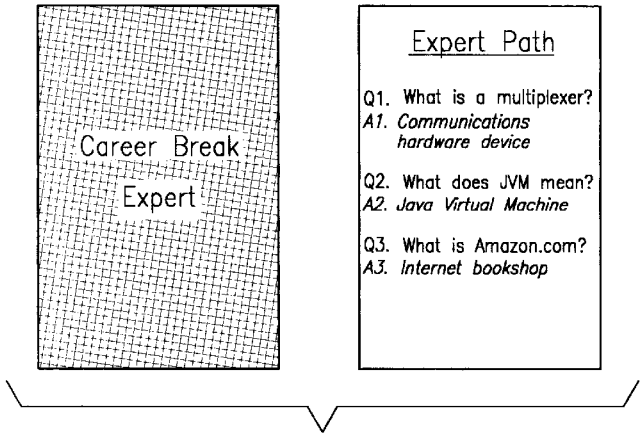
FIG. 7 is a schematic front and back view of an example trivia card of the present invention.
Figure 8:
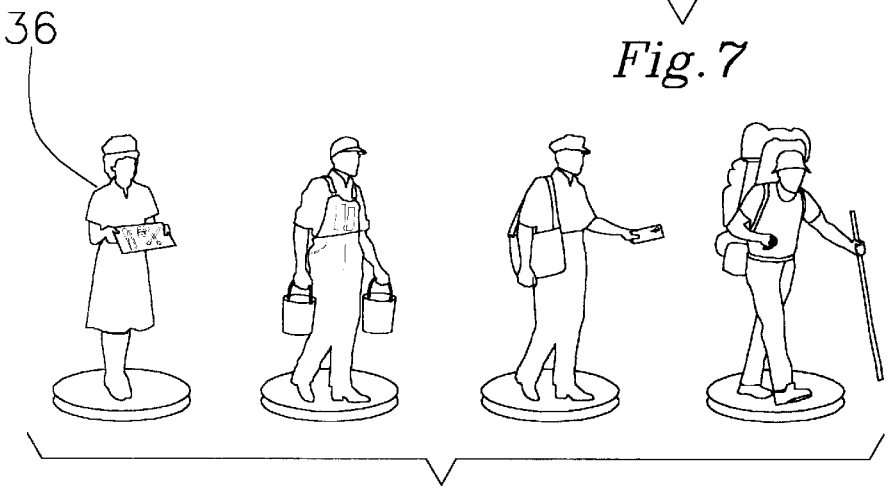
FIG. 8 is a schematic perspective view of game tokens of the present invention.
Figure 9:
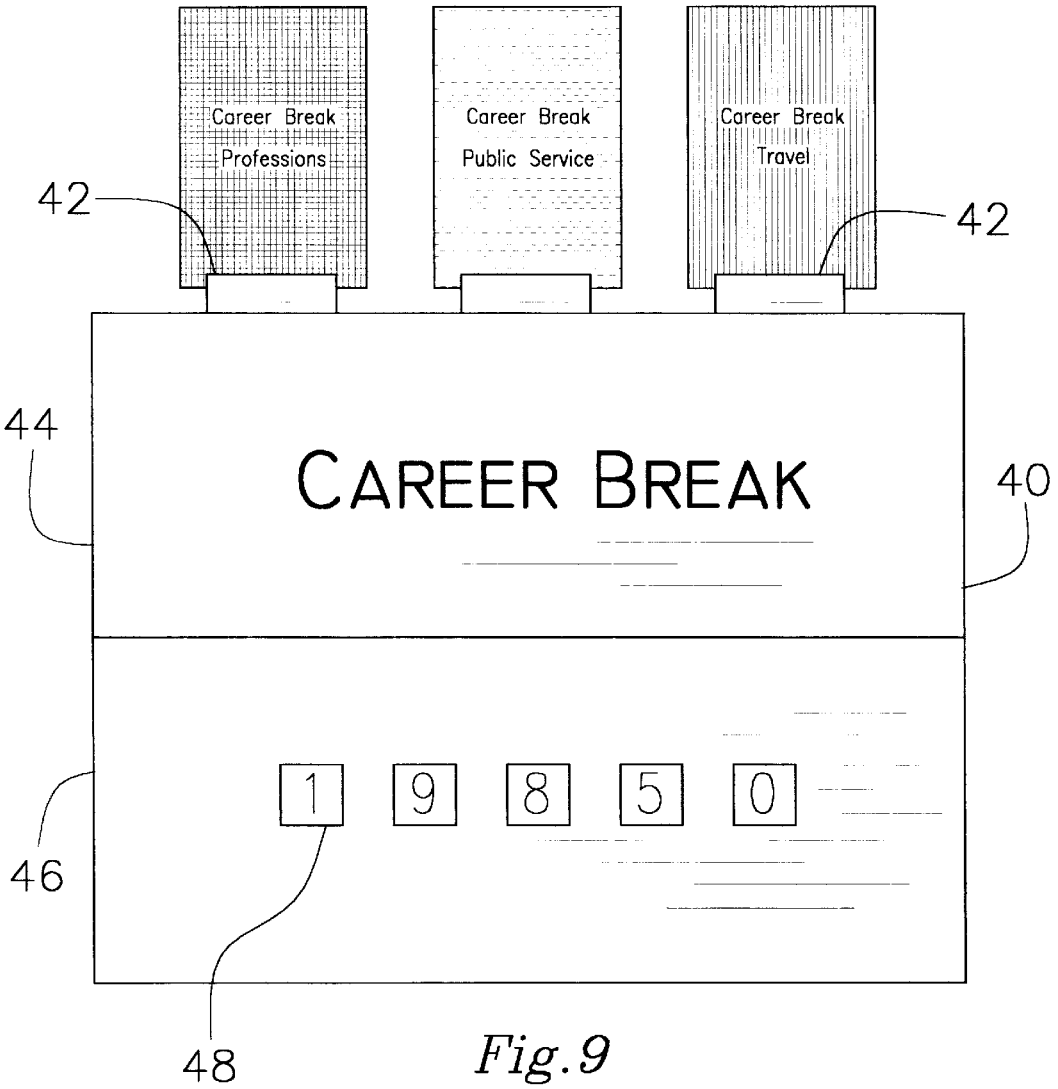
FIG. 9 is a schematic front view of score keeper and card holder of the present invention.
Figure 10:
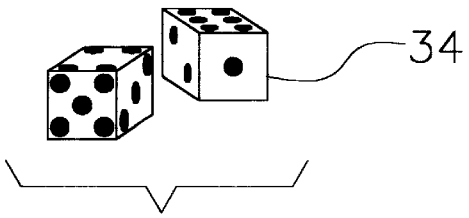
FIG. 10 is a schematic perspective view of two six sided die of the present invention.

With reference now to the drawings, and in particular to FIGS. 1 through 10 thereof, a new board game apparatus embodying the principles and concepts of the present invention and generally designated by the reference numeral 10 will be described.

As best illustrated in FIGS. 1 through 10, the board game apparatus 10 generally comprises a preferably rectangular game board 11 with an upper side 12, a bottom side 13, a left side 15 and a right side 14. The game board has a trapezoid 16 upon it. The trapezoid is preferably an isosceles trapezoid and has a top base 17 shorter than a bottom base 18, and the top base forms the apex of the trapezoid. The trapezoid is divided into a plurality of horizontal levels 20, and the levels are subdivided into compartments 21. The compartments are each associated with an occupation. Preferably, the occupations are selected from the group comprising professions 22, industry 23, tourism 24 and public service 25. Industry also includes trade and tourism also includes leisure. Each of the levels is connected to the next adjacent level by a career break path 26, the career break path being preferably formed by 8 circles. The career break paths each have an industry assigned to them with the exception of three that are designated as "Travel Paths" 27.

A plurality of cards 30 are placed on the board. The cards are located near the upper side of the board, and arranged to the right and left of the trapezoid. The cards have indicia thereon wherein the indicia indicate questions corresponding to the occupation landed on. The cards also contain questions of general trivia. Preferably, the questions are divided into three categories of difficulty 32. There are also cards provided when a person uses one of the paths called a "Travel Path" 31.

A plurality of scoring cards 33 are placed on the board. The cards preferably have a value of two hundred points, five hundred points or one thousand points. The points correspond to the level of difficulty of the question asked.

At least one die is used to determine movement around the board. Preferably two six sided die 34 are used. Movement is monitored with game pieces 36. The game pieces preferably depict one of the four mentioned occupations.

Preferably, a scoring means 40 is utilized to track points as they are acquired. The counter contains three slots 42, or spaces where three cards are kept. These cards are given to keep track of the amount of paths the participant has successfully gone through. The counter is preferably a box. The box has a top portion 44 and a bottom portion 46, the top portion having the three holding means. The bottom portion contains the counter 48 for keeping score.

In use, the participants began by selecting one of the four occupations. Each participant selects a game piece corresponding to the selected occupation. In turn, each participant rolls the dice to determine the amount of compartments to move. The participants move the game piece beginning at a bottom left corner of the trapezoid. A card is drawn corresponding to the indicia of the compartment landed on. The participant picks one of three levels of difficulty on the card and answers the corresponding question on the card. The cards will ask questions regarding the occupation, or they may be general, worldwide trivia. If the answer is right, the participant gets to roll again and receives points according to the difficulty. For points, the participant is given a card representing 200, 500 or 1,000 points. The more difficult the question answered, the more points are awarded. If the participant answers incorrectly, the next participant rolls the dice and moves their piece to a compartment and draws a card.

The participants must use the career break paths, called at least 3 times in a game. If a participant does not use a path, they simply move up to the next level. The participant chooses when they want to use a path. However, the player must choose paths outside of their chosen occupation, and they must choose the "Travel Path" at least once. There are eight spots on a path and 8 questions must be cumulatively be answered correctly in order to pass the CareerBreak. Five hundred points are given for each correct answer on a CareerBreak. The final path before reaching the apex of the trapezoid is called the "Expert Path." Here the participant must consecutively answer correctly three questions relating to their occupation. No points are awarded for answering correctly on the expert path, however if the participant on the expert path does not know the answer and another participant does, the participant on the expert path loses 500 points.

A player wins by simultaneously reaching the apex of the trapezoid while having at least 30,000 points and having had traveled on three CareerBreaks including one Travel Path. Alternatively, a player can win by reaching the apex and having only 15,000 points if they have successfully navigated through 5 CareerBreaks, including one Travel Path. If a participant reaches the apex without the requisite points or CareerBreaks, that participant will have to start at the beginning of the trapezoid.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a game including the steps of:

providing a rectangular game board with an upper side, a bottom side, a left side and a right side, said game board having an isosceles trapezoid there upon, said trapezoid having a top base shorter than a bottom base, said top base being an apex of said trapezoid, said trapezoid being divided into a plurality of linear levels, said levels being subdivided into a plurality of compartments, said levels forming a path, said path comprising a main path and a career break path, said compartments having associated therewith a reference to a respective occupation, said occupation being selected from the group comprising professions, industry, tourism and public service, each of said levels being connected to the next adjacent linear level by a plurality of career break paths, said career break paths being formed by a plurality of spots, each of said career break paths having arcuate shapes for differentiating the career break path from the main path;

providing a plurality of cards placed on the board, said cards being located near said upper side of said board, said cards being arranged to the right and left of said trapezoid, said cards having indicia thereon wherein said indicia indicating questions corresponding to said occupation, said cards also indicating questions of general trivia, said questions being divided into three categories of difficulty;

providing a plurality of scoring cards, said cards having indicia thereon wherein said indicia indicating questions corresponding to said occupation, said scoring cards having a value of two hundred points, five hundred points or one thousand points, a relatively higher value of said points corresponding to a relatively higher level of difficulty;

providing two six sided die;

providing game pieces representative of said occupations;

providing a scoring apparatus, said scoring apparatus being a box, said box having a top portion and a bottom portion, said top portion having three holding means for holding three of said cards, said participant acquiring one of three cards by correctly answering eight questions from the cards while participant is traveling along the career break paths, said bottom portion having a counter for keeping score of the point values earned from correct answers to questions from cards while participant is traveling on said main path;

selecting one of four occupations, said occupations being from the group consisting of professions, industry, tourism, and public service;

each participant selecting a game piece corresponding to selected occupation;

each participant in turn rolling the dice to determine the amount of compartments to move, moving said game piece beginning at a bottom left corner of said main path located in said trapezoid, drawing a card corresponding to the indicia of said compartment landed on, picking a level of difficulty on said card, answering question on said card, rolling again and receiving said scoring card corresponding to difficulty level of question for correct answer, losing a turn for incorrectly answering a question;

each participant being required to travel on said career break paths at least three times prior to advancing to the next compartment level, each participant choosing when to travel on said career break paths;

each participant being required to correctly answer a predetermined number of questions while traveling on said career break paths, each participant required to obtain a card from two of each of the three occupations after which the participant has selected an occupation, said participant having to obtain at least one card from a travel portion of said career break path, said participant acquiring said card upon correctly answering eight questions, winning the game by being the first participant to earn a predetermined number of cards from the career break paths, accumulate a total of a predetermined number of points, and have correctly answered three questions from an expert card having indicia indicating questions of the occupation chosen by the participant, said questions of said expert card containing questions of a high degree of difficulty and have landed on the final compartment of the main path, located at an apex of said trapezoid.

2. A method of playing a game including the steps of:

providing a game board with an upper side, a bottom side, a left side and a right side, said game board having a trapezoid there upon, said trapezoid being divided into a plurality of linear levels, said levels being subdivided into a plurality of compartments, said levels forming a path, said path comprising a main path and a career break path, said compartments having associated therewith a reference to a respective occupation, said occupation being selected from the group comprising professions, industry, tourism and public service, each of said levels being connected to the next adjacent linear level by a plurality of career break paths, said career break paths being formed by a plurality of spots, each of said career break paths having shapes for differentiating the career break path from the main path;

providing a plurality of cards placed on the board, said cards having indicia thereon wherein said indicia indicating questions corresponding to said occupation, said cards also indicating questions of general trivia, said questions being divided into three categories of difficulty;

providing a plurality of scoring cards, said cards having indicia thereon wherein said indicia indicating questions corresponding to said occupation, said scoring cards having a value of two hundred points, five hundred points or one thousand points, a relatively higher value of said points corresponding to a relatively higher level of difficulty;

providing two six sided die;

providing game pieces representative of said occupations;

providing a scoring apparatus, said scoring apparatus being a box, said box having a top portion and a bottom portion, said top portion having three holding means for holding three of said cards, said participant acquiring one of three cards by correctly answering eight questions from the cards while participant is traveling along the career break paths, said bottom portion having a counter for keeping score of the point values earned from correct answers to questions from cards while participant is traveling on said main path;

selecting one of four occupations said occupations being from the group consisting of professions, industry, tourism, and public service;

each participant selecting a game piece corresponding to selected occupation;

each participant in turn rolling the dice to determine the amount of compartments to move, moving said game piece beginning at a bottom left corner of said main path located in said trapezoid, drawing a card corresponding to the indicia of said compartment landed on, picking a level of difficulty on said card, answering question on said card, rolling again and receiving said scoring card corresponding to difficulty level of question for correct answer, losing a turn for incorrectly answering a question;

each participant being required to travel on said career break paths at least three times prior to advancing to the next compartment level, each participant choosing when to travel on said career break paths;

each participant being required to correctly answer a predetermined number of questions while traveling on said career break paths, each participant required to obtain a card from two of each of the three occupations after which the participant has selected an occupation, said participant having to obtain at least one card from a travel portion of said career break path, said participant acquiring said card upon correctly answering eight questions, winning the game by being the first participant to earn a predetermined number of cards from the career break paths, accumulate a total of a predetermined number of points, and have correctly answered three questions from an expert card having indicia indicating questions of the occupation chosen by the participant, said questions of said expert card containing questions of a high degree of difficulty, and have landed on the final compartment of the main path, located at an apex of said trapezoid.

* * * * *